United States Patent [19]

Karr

[11] 3,964,704

[45] June 22, 1976

[54] OPERATING MECHANISM FOR RAILROAD CROSSING GATE

[75] Inventor: Jerry W. Karr, Blue Springs, Mo.

[73] Assignee: Harmon Industries, Inc., Grain Valley, Mo.

[22] Filed: Sept. 23, 1974

[21] Appl. No.: 508,670

[52] U.S. Cl. ..... 246/125; 49/138; 246/261; 246/272; 246/293

[51] Int. Cl.[2] ..... B61L 29/22

[58] Field of Search ..... 246/125, 261, 260, 272, 246/111, 292, 293, 479; 49/138, 26, 28; 14/53, 60, 68; 116/132 R

[56] References Cited

UNITED STATES PATENTS

| | | | |
|---|---|---|---|
| 1,888,058 | 11/1932 | Vincent | 246/125 |
| 3,038,991 | 6/1962 | Swanton | 246/125 |
| 3,060,312 | 10/1962 | Jackson | 246/261 |

*Primary Examiner*—Trygve M. Blix
*Assistant Examiner*—Reinhard J. Eisenzopf
*Attorney, Agent, or Firm*—D. A. N. Chase

[57] ABSTRACT

The operating mechanism of a railroad crossing gate employs a variable mechanical advantage connection to transmit force from the drive motor to the gate member to raise and lower the same. The main shaft of the mechanism serves as a mount for the gate member and its counterweights, and an operating arm is fixed to the shaft and extends radially therefrom. A crank is driven by reduction gearing and is connected to the arm by a sliding coupling which reciprocates on the arm longitudinally thereof as the crank rotates. The axis of rotation of the crank is located such that the mechanical advantage is high when the gate member is in either its raised or its lowered position, decreasing to a ratio approaching unity at the midpoint of travel in either direction. Accordingly, the starting load is minimized, the gate member is accelerated once it is in motion, and its speed is then reduced as it nears the end of its travel. The crank and operating arm toggle when the gate member is in its lowered position to provide a positive mechanical lock.

12 Claims, 10 Drawing Figures

OPERATING MECHANISM FOR RAILROAD CROSSING GATE

This invention relates to improvements in apparatus for raising and lowering railroad crossing gates and, more particularly, to an improved gate operating mechanism employing variable mechanical advantage in its operating cycle.

Railroad crossing gates in widespread use employ long gate arms as traffic barriers which are normally upright and are swung to a lowered, horizontal position when an approaching train is detected. These gate members are required to have a long reach and may have a length on the order of 60 feet (18.3 meters). Although counterweights are utilized, even a member of considerably shorter length presents a heavy starting load to the gate operating mechanism when it is in its extended horizontal position, due to its inherent size and weight.

The operating mechanisms for railroad crossing gates in use at the present time commonly employ a reversible DC motor and a reduction gear drive to raise and lower the gate member. The motor is supplied by batteries at the crossing site which are maintained in a charged condition by an AC power line. In the event of a power failure, the batteries must have sufficient capacity to operate the gate mechanism for a predetermined period of time, normally 24 hours. As much of the available battery energy is consumed in supplying the high starting current demanded by the motor in raising the gate member to return it to its normal, upright position after each passing train, the inherently high battery drain in installations of this type requires the utilization of high capacity storage batteries with their attendant expense. Furthermore, oversize wire is necessary in order to handle the excessive starting current, and the fixed mechanical advantage of the reduction gear drive limits the starting torque and may restrict the ability of the mechanism to lower the gate member should it become frozen in its raised position by the accumulation of ice and snow under wintertime conditions.

The gear ratio selected in such reduction gear drives represents a compromise between starting torque and speed. Certainly, a higher ratio could be utilized to increase the starting torque and decrease the starting current, but this would mean that the gate member would swing very slowly (particularly when it is being raised) thereby prolonging the traffic tieup at the crossing and encouraging motorists to attempt to slip under the gate before it is fully raised.

It is, therefore, an important object of the present invention to provide an operating mechanism for a railroad crossing gate which does not have the inherent disadvantages discussed above, and which improves the reliability and reduces the expense of railroad crossing gate installations.

As a corollary to the foregoing object, it is an important aim of this invention to provide an operating mechanism as aforesaid having variable mechanical advantage and, in particular, a high mechanical advantage at the start of upward movement of the gate member away from its lowered position.

Another important object of this invention is to orovide an operating mechanism as aforesaid which provides high mechanical advantage at the start of upward movement of the gate member, followed by substantially lower mechanical advantage after the member is in motion in order to minimize the starting load on the mechanism and then accelerate the gate member once it is in motion.

Still another important object of this invention is to provide an operating mechanism as in the preceding object, wherein the mechanical advantage progressively increases as the gate member approaches its raised position in order to reduce the speed of the member as it nears the end of its travel, thereby preventing possible damage to the member due to a whipping action that could be produced by suddenly stopping its motion when it arrives at the raised position.

Yet another important object of this invention is to provide an operating mechanism as aforesaid which is reversible and, during its reverse operational cycle in lowering the gate member provides high mechanical advantage at the start of downward movement, substantially lower mechanical advantage thereafter, and then progressively increased mechanical advantage as the member approaches its lowered position, thereby resulting in the availability of high starting torque if necessary and causing a braking action as the member approaches its lowered position.

Furthermore, it is an important object of this invention to provide such an operating mechanism which employs a reversible electric motor and, by virtue of the aforesaid variable mechanical advantage, materially reduces the starting current of the motor and, therefore, the current drain on the batteries at the crossing site, thereby reducing the wire size required and increasing the battery life in the event of a power failure.

Additionally, it is an important object of the present invention to provide an operating mechanism as aforesaid which locks by a toggle action when the gate member is in its lowered position in order to positively prevent someone from raising the gate member in an attempt to pass through the protective barrier.

Still further, it is a specific and important aim of this invention to provide such a mechanism which accomplishes the foregoing objects through the use of an uncomplex mechanical arrangement not involving multiple speed transmissions or gear changing.

DETAILED DESCRIPTION

Figure 1:
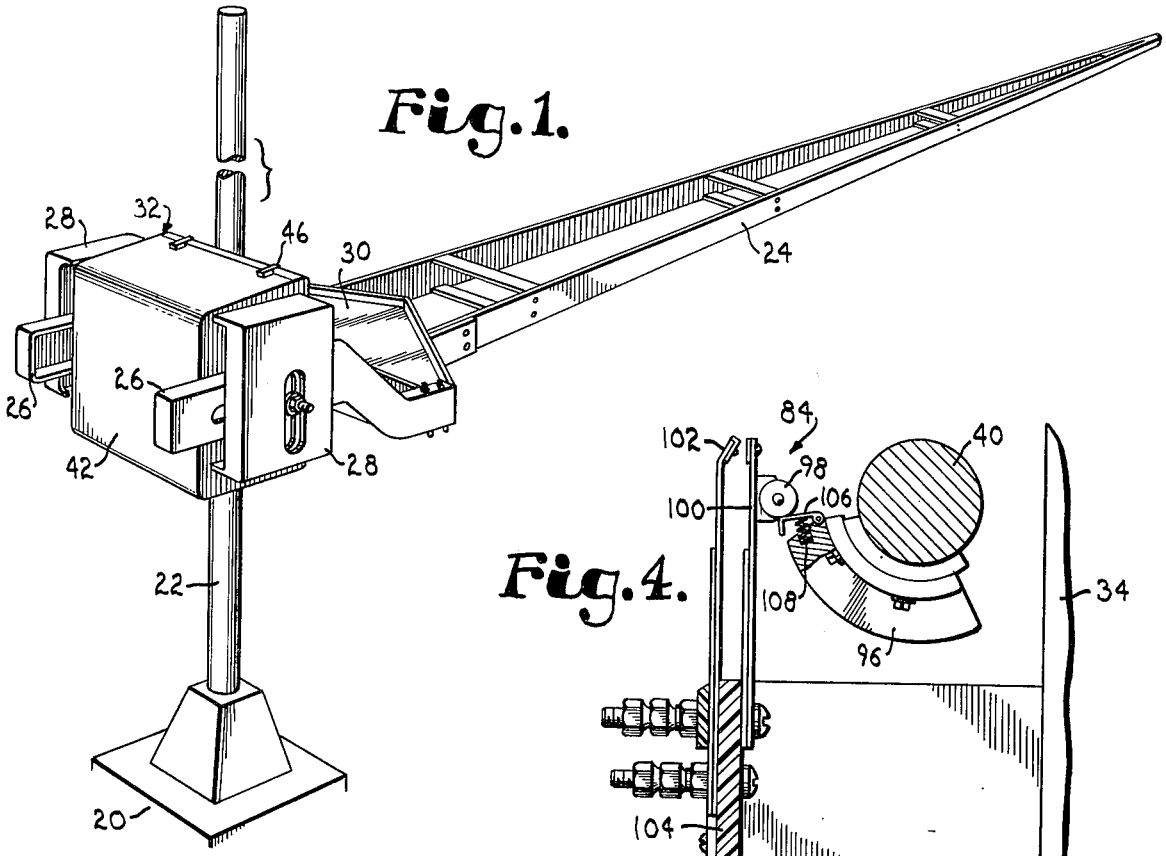
FIG. 1 is a perspective view of a railroad crossing gate installation and shows the gate member in its horizontal, lowered position where it presents a traffic barrier.

Referring initially to FIG. 1, the gate apparatus includes a base 20 supporting a standard 22 adjacent a railroad crossing to be protected (not illustrated). A gate member 24 in the form of a long arm is shown in its horizontal, lowered position in which, in actual use, it would extend across the road or highway in the usual manner and serve as a warning barrier when a train is passing. As is conventional, the gate member 24 is counter-balanced by a pair of counterweight arms 26 which carry counterweights 28 and are rigidly jointed to the inner end of the gate member 24 by a transition pan 30. The operating mechanism for the gate member 24 is contained in a rectangular housing 32 secured to the standard 22. Electric power for the operating mechanism is provided by batteries (not shown) at the crossing site which are maintained fully charged by energy supplied by an alternating current power line under normal operating conditions.

Figure 4:
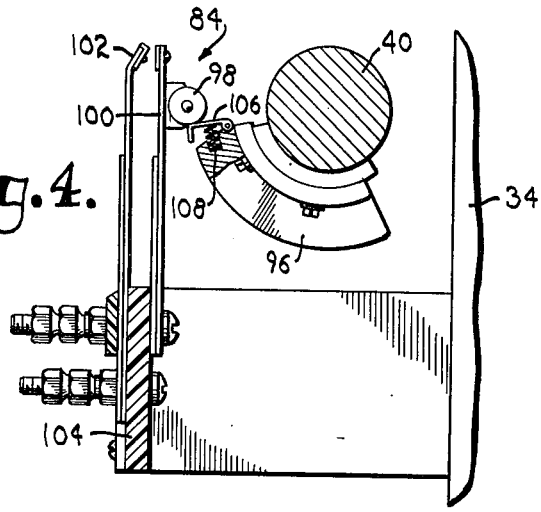
FIG. 4 is a further enlarged, fragmentary cross-sectional view taken along line 4—4 of FIG. 3.
Figure 3:
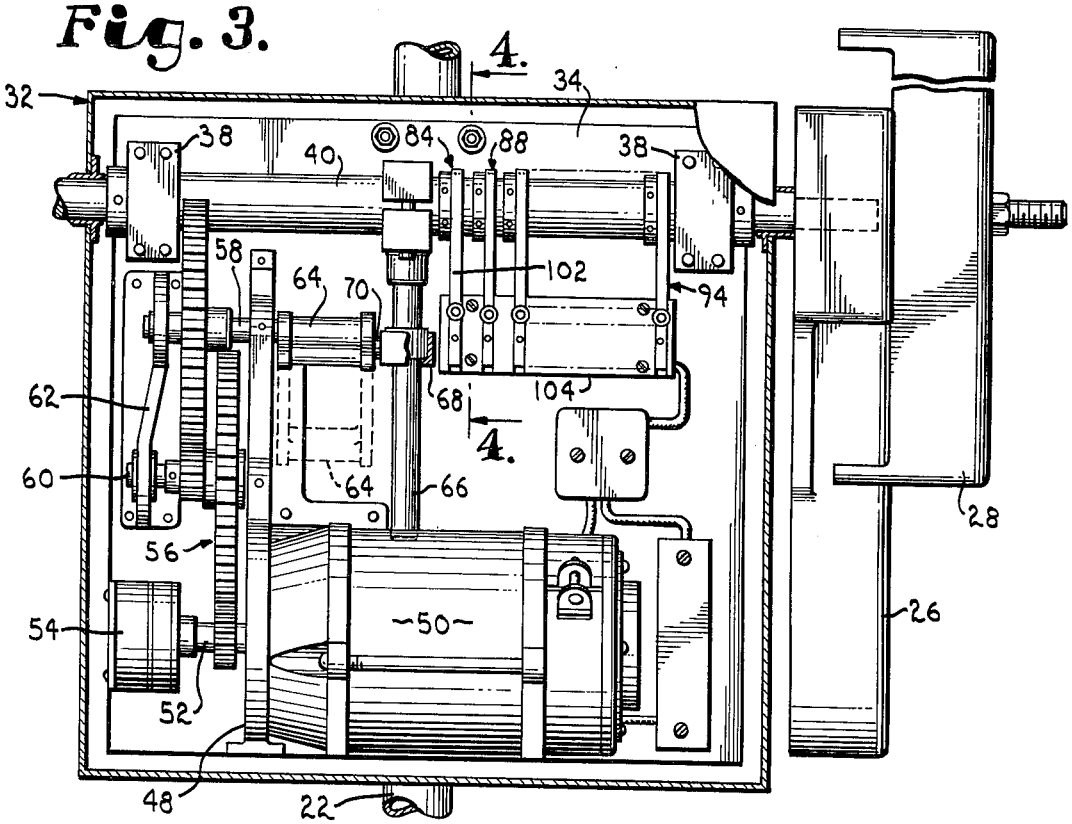
FIG. 3 is an elevational view of the operating mechanism on the same scale as FIG. 2, the view being taken in the direction indicated by line 3—3 in FIG. 2 and the housing and certain other components external to the housing being broken away to reveal the mechanism in detail as it appears with the gate member in its raised, upright position.
Figure 2:
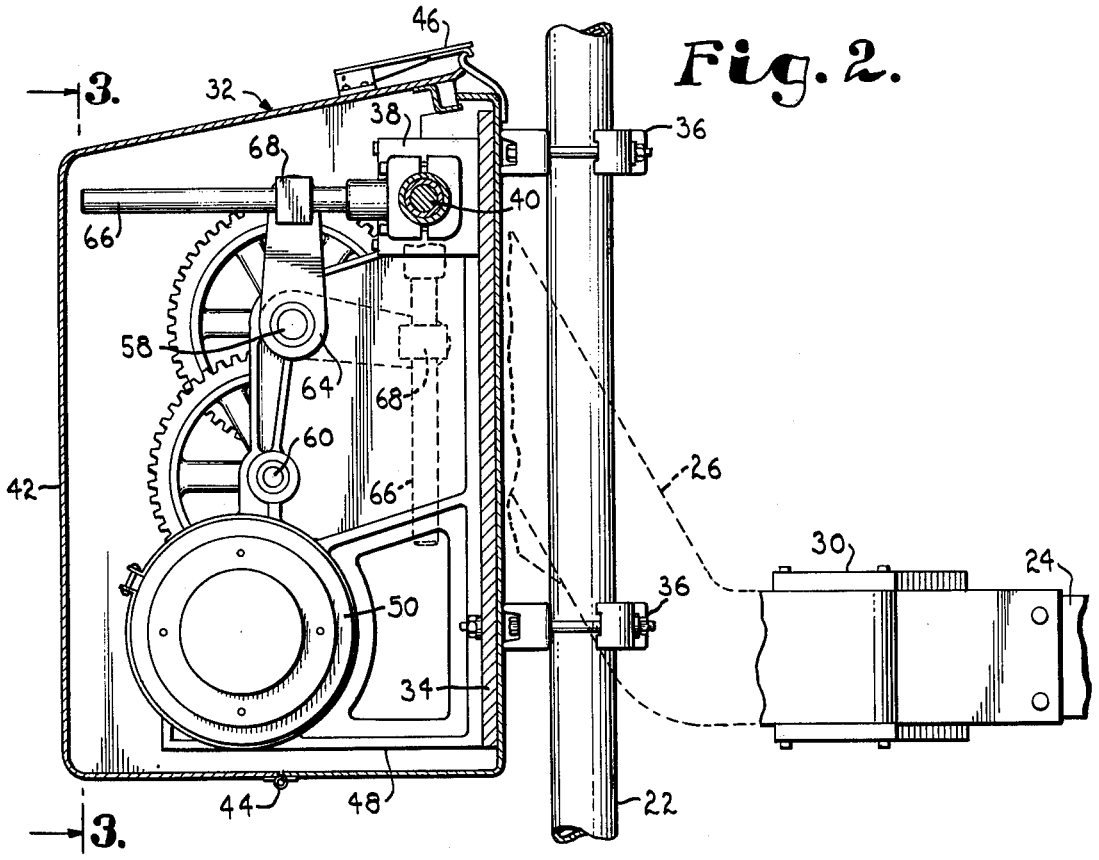
FIG. 2 is an enlarged, vertical sectional view through the housing of the operating mechanism of the gate structure illustrated in FIG. 1, the cam switch assembly being removed for clarity and the standard and the gate member being shown fragmentarily and in phantom lines.

The operating mechanism of the present invention is shown in detail in FIGS. 2–4. An upright, square baseplate 34 is rigidly secured to the standard 22 by a pair of vertically spaced clamps 36 and, adjacent its upper corners, serves as a mount for a pair of bearing assemblies 38 in which a horizontal shaft 40 is journaled. The shaft 40 defines the axis about which the gate member 24 is swung, and is the main shaft of the mechanism to which the counterweight arms 26 are fixed at the respective ends of the shaft 40. As is clear in FIG. 3, the opposed ends of the shaft 40 extend through the housing 32, each end being keyed to the corresponding counterweight arm 26. The housing 32 is provided with a removable cover 42 attached to the fixed portion of the housing by a hinge 44 at the bottom and by a pair of releasable latches 46 at the top.

A motor bracket 48 extends from the baseplate 34 toward the viewer in FIG. 3 and mounts a reversible DC motor 50 adapted to operate from a 12 volt battery supply and preferably a high torque, low rpm type (typically 300 rpm). The output shaft 52 of the motor 50 is connected to an electromagnetic brake 54 and, through reduction gearing 56, drives a crankshaft 58. Both the crankshaft 58 and a jackshaft 60 of the reduction gear drive 56 are supported by bearings carried by the motor bracket 48 and a bracket plate 62 above the electromagnetic brake 54.

A crank 64 is keyed to the right end portion of the crankshaft 58 as viewed in FIG. 3. An operating arm 66 is fixed to the main shaft 40 centrally thereof and comprises a straight shaft extending radially outwardly from the axis of rotation of the main shaft 40. A sleeve bearing 68 has an inner bearing race surrounding the arm 66 and slidable thereon longitudinally thereof, the outer race of the bearing 68 being secured to a crank pin 70 which is rotatable in the outer end of the crank 64 about an axis parallel to the axis of the crankshaft 58. The sleeve bearing 68 and the crank pin 70 from a coupling device between the crank 64 and the operating arm 66 as will be discussed more fully hereinbelow.

Figure 10:
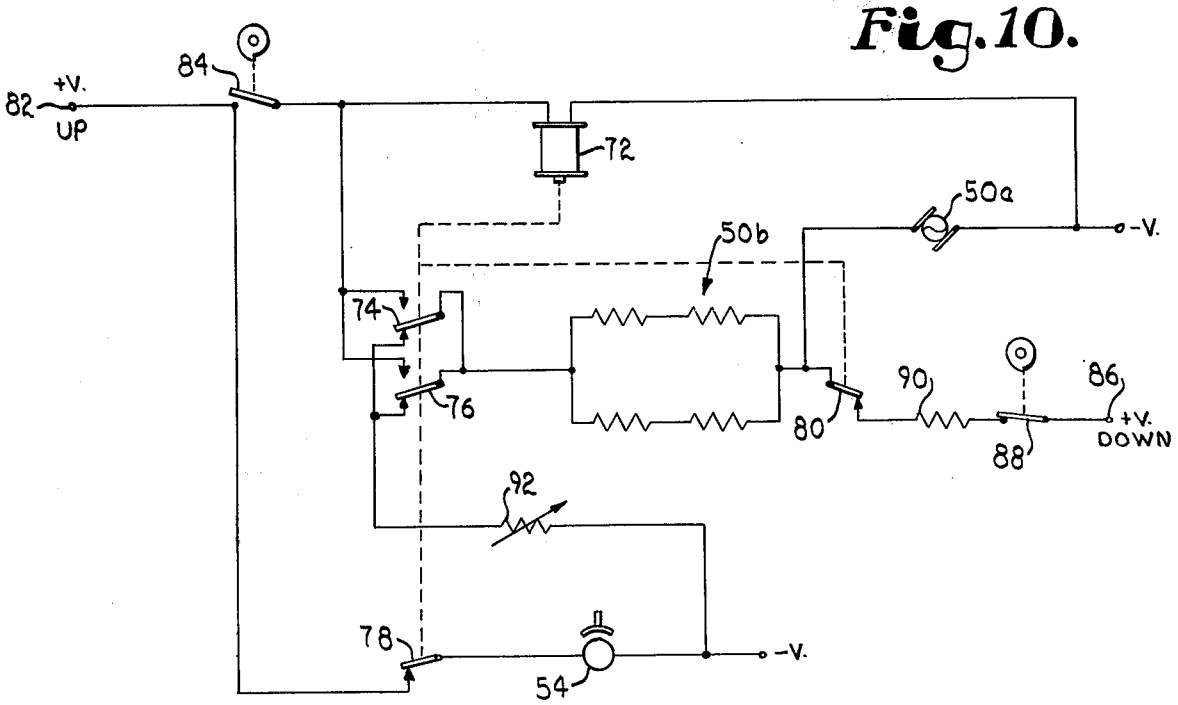
FIG. 10 is an electrical schematic diagram of the control circuit for the motor drive.

Referring to FIG. 10, the armature of the motor 50 is diagrammatically illustrated at 50*a* and its field windings by the parallel resistor arrangement 50*b*. A control relay has a coil 72 and four sets of relay switch contacts 74, 76, 78 and 80. A positive direct voltage is applied to the "up" terminal 82 when it is desired to raise the gate member 24 or hold it in its raised position. A cam switch 84 is interposed between the up terminal 82 and the relay coil 72. When it is desired to lower the gate member 24 or hold it in its lowered position, a positive direct voltage is applied to the "down" terminal 86, such terminal being connected to the relay switch 80 through a cam switch 88 and a current limiting resistor 90. The two terminals labeled -V represent the other electrical side of the DC supply; the variable resistor 92 in series between the normally closed contacts of the relay switches 74 and 76 and the negative return is for the purpose of controlling the extent of the dynamic braking action of the motor 50 when the gate member 24 is being lowered, as will be subsequently discussed. The positions of all relay and cam switches in FIG. 10 represent the normal condition of the apparatus, i.e., gate member 24 in its raised (vertical) position generally parallel with the standard 22 and displaced 90° from that illustrated in FIG. 1.

The cam switch 84 is shown in detail in FIG. 4. As may be seen in FIG. 3, the cam switch 84 is the first such switch (leftmost) of a bank of cam switches including cam switch 88 and a group of switches 94 forming no part of the present invention and employed to control accessories at the crossing site such as a warning bell, flashing lights, etc. The cam 96 (FIG. 4) of cam switch 84 is mounted on the main shaft 40 and is engageable with a follower 98 carried by a contact blade 100. A second contact blade 102 completes the switch assembly, and both blades 100 and 102 have their lower ends secured to an insulated terminal strip 104.

The cam switch 84 is closed from 0° through 89° during raising of the gate member 24, zero degress corresponding to the lowered, horizontal position of the member 24 illustrated in FIG. 1. At 90° when the member 24 is in its raised position, the relative positions of the cam 96 and the follower 98 are as shown in FIG. 4. During lowering of the member 24, the cam switch 84 is closed from approximately 83° through 0°, the lag in closure being accomplished by a pivotal cam extension 106 mounted on the end of cam 96 that becomes the leading end during lowering of gate member 24 (clockwise rotation of shaft 40 as viewed in FIG. 4). The extension 106 is biased by a spring 108 which is compressed by the cam follower 98 as the shaft 40 begins clockwise movement to delay closure of blade 100 against blade 102 until the gate member 24 reaches the 83° position.

The cam switch 88 is of the same construction as cam switch 84, except that a cam lobe of constant arcuate dimension is employed. Cam switch 88 is closed from 46° through the 90° position and remains closed when the gate member 24 is raised.

OPERATION

At a protected railroad crossing, detection equipment is utilized to sense an approaching train. When this occurs, positive voltage is delivered to the down terminal 86 (FIG. 10) and positive voltage is removed from the up terminal 82. The motor 50 is energized by the positive voltage at terminal 86 and is parallel excited, a circuit through the armature 50*a* being traceable through the closed cam switch 88 and relay switch 80, and a circuit through the field windings 50*b* being traceable through cam switch 88, relay switch 80, the windings 50*b*, relay switch 76, and resistor 92. Relay coil 72 is de-energized at this time and will remain de-energized during lowering of the gate member 24 since positive voltage is not available at the up terminal 82.

Figure 5:
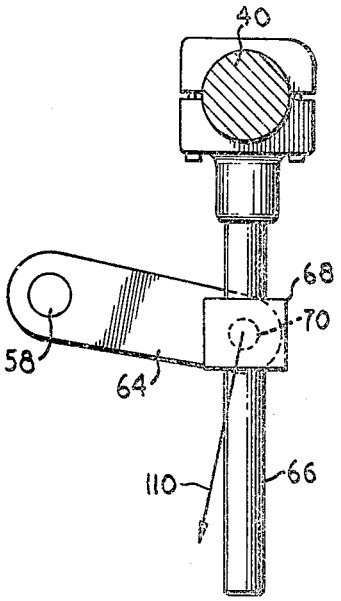
FIGS. 5–9 are diagrammatic illustrations showing the relative dispositions of the crank and operating arm of the mechanism at representative points in its operating cycle, FIG. 5 corresponding to the fully raised position of the gate member and FIG. 7 corresponding to the fully lowered position.

Before commencement of downward movement of the gate member 24, the crank 64 and the operating arm 66 of the mechanism are in the positions shown in FIG. 5 and in full lines in FIG. 3 and phantom lines in FIG. 2. The operating arm 66 may be considered as essentially an extension of the gate member 24; its longitudinal axis is lengthwise of the gate member 24 and thus the arm 66 is in a vertical orientation when the gate member is in its raised, 90° position. At the commencement of downward movement of the gate member, the line of action of the force applied by the crank 64 to the arm 66 is as illustrated by the vector 110 in FIG. 5. The moment arm of the crank 64 is short of a right angle with the longitudinal axis of the operating arm 66 by approximately 15° to 20°. However, by far the major component of the force 110 is longitudinally of the arm 66; thus at the outset a relatively large angular displacement of the crank 64 is required to cause a small angular displacement (clockwise) of the arm 66. Accordingly, the mechanical advantage is high at the start of downward movement of the gate member and progressively decreases to a ratio approaching 1:1 at approximately the 45° position of the arm 66 illustrated in FIG. 6. At this intermediate position of the arm 66, the gate member has accelerated to maximum speed and the force applied by crank 64 is at a right angle to the longitudinal axis of arm 66 as depicted by the vector 112.

Figure 6:
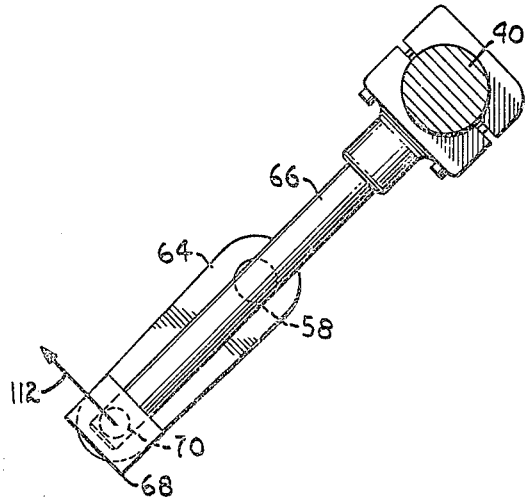
Figure 7:
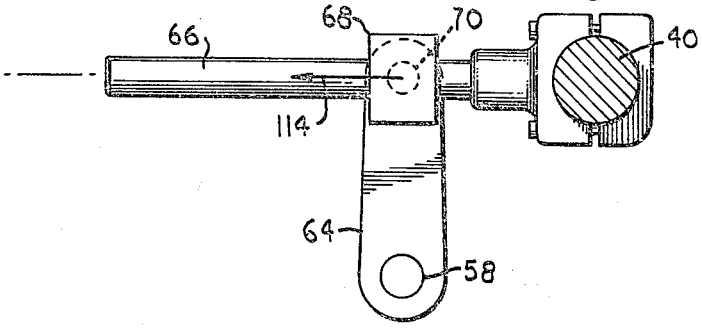

Since the cam switch 88 remains closed only until the gate member reaches 46°, power to the motor 50 is removed once the mechanical components reach approximately the positions illustrated in FIG. 6, and the motor 50 then provides dynamic braking by generator action. In addition, the mechanical advantage of the mechanism serves as a brake as it now progressively increases until the gate member 24 reaches its lowered, zero degree position where the crank 64 and the arm 66 are then as shown in FIG. 7. The FIG. 7 illustration also corresponds to FIG. 1 and FIG. 2 (full lines). At this time, the moment arm of the crank 64 and the longitudinal axis of the arm 66 form a right angle and thus provide a positive mechanical lock by a toggle action. If it is attempted to overcome the warning by grasping the gate member 24 and attempting to raise it, this will be unsuccessful since arm 66 cannot be rotated by leverage applied to shaft 40. It may be appreciated, therefore, that the axis of the crankshaft 58 is located such that a toggle action is provided at the zero degree position but not at the 90° position.

In the foregoing discussion of closing operation of the gate, it should be understood that the interruption of power to the motor 50 may be at other than the 45° position and could, for example, be in the range from 30° to 60° as desired. The gate member 24 will free fall due to gravity, but the high mechanical advantage at the outset is important in the event that ice and snow under wintertime conditions, for example, have caused freezing of exposed mechanical parts which must first be broken loose.

Once the detection equipment senses that the train has passed and that the crossing may be safely used, positive voltage is delivered to the up terminal 82 and is removed from the down terminal 86. Cam switch 84 is closed at zero degrees, so relay coil 72 is immediately energized to operate all of the relay switches 74, 76, 78 and 80. The armature 50*a* and the field windings 50*b* are now excited in series and the current flow through the windings 50*b* is reversed as compared with down operation. The motor circuit is established through the relay switch 74 which is now closed against its upper contact; a parallel path is also established through the upper contact of relay switch 76. At this time, the mechanical advantage is theoretically infinite as the line of action of the force applied to the arm 66 by the crank 64 is directed along the longitudinal axis of the arm 66 as illustrated in FIG. 7 by the force vector 114.

Figure 8:
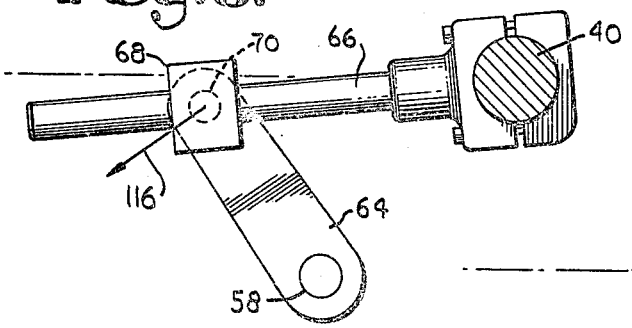
Figure 9:
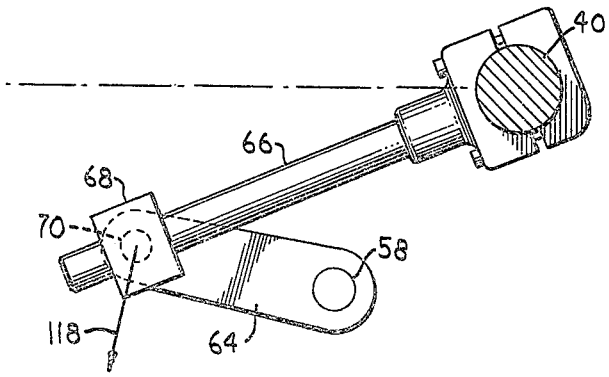

At the start of upward movement of the gate member 24, it is important to have high torque available or the starting current of the motor 50 will be excessive. This is accomplished in the present invention as illustrated by a comparison of FIGS. 7 and 8 where it may be seen that the angular displacement of the crank 64 is large at the outset as compared with the degree of angular movement imparted to the arm 66. Being theoretically inifinite when the motor is initially energized, the mechanical advantage is very high and thus the starting load due to the inertia of the gate member 24 is readily overcome. Once in motion, the gate member is accelerated although the motor speed remains relatively constant, since the mechanical advantage progressively decreases as seen by following the sequence of FIGS. 8, 9 and 6. Noting FIG. 8, the major component of the force vector 116 is still longitudinally of the arm 66, whereas in FIG. 9 the major component of the resultant vector 118 is now perpendicular to the longitudinal axis of the arm 66. When the minimum mechanical advantage is reached in FIG. 6, the component axially of arm 66 disappears momentarily as the reciprocating sleeve bearing 68 reverses its direction of movement. (Since shaft 40 is now rotating counterclockwise, the sense of the vector 112 is reversed.) Now, as motion continues, the mechanical advantage increases and the gate member 24 decelerates. Accordingly, the speed of the gate member is reduced as it nears the end of its path of travel, and the crank 64 and arm 66 ultimately assume the relative positions thereof illustrated in FIG. 5.

The deceleration phase just referred to is also important in the present invention in order to reduce the possibility of damage to a long gate arm by sudden stopping of its motion at the upright position. The location of the axis of the crankshaft 58, however, is such as to prevent a toggle action so that the gate member 24 is capable of being lowered by a free fall. When the gate member is in the raised position, it is held by the electromagnetic brake 54 which is energized at 90° by the opening of cam switch 84 and accompanying de-energization of relay coil 72. Cam switch 84 does not open until 90° since the follower 98 must clear the cam extension 106 (FIG. 4). However, since extension 106 yields due to the spring 108 in the reverse direction, minor movement of the gate member 24 under the effect of the wind is permitted without re-energizing the motor 50.

Having thus described the invention, what is claimed as new and desired to be secured by Letters Patent is:

1. In a gate mechanism having a gate member mounted for swinging movement about a generally horizontal axis between a raised position and a lowered position corresponding to open and closed conditions of the gate respectively, and where drive means is employed for rotating said gate member about said axis to swing the member from said lowered to said raised position, the improvement comprising force transmitting means coupling said drive means with said member and providing high mechanical advantage at the start of upward movement thereof, substantially lower mechanical advantage after the member is in motion, and progressively increased mechanical advantage as the member approaches its raised position, whereby to minimize the starting load on the drive means, accelerate the member once it is in motion, and then reduce the speed of the member as it nears the end of its travel, said force transmitting means including an operating arm extending transversely of said axis and secured to said member, said arm having first and second angularly spaced positions corresponding to said raised and lowered positions of the member respectively, a rotatable crank connected with said drive means, and a coupling device pivotally secured to said crank and reciprocable on said arm longitudinally thereof, said drive means being operable to rotate said crank in a direction to swing said arm from said second to said first position thereof to thereby swing said member to its raised position.

2. The improvement as claimed in claim 1, wherein said force transmitting means further includes means mounting said crank with its axis of rotation located to direct the major component of the force applied to said arm by the crank longitudinally of the arm when the latter is in either its first or second position, and at a right angle to said arm as the latter is rotated through an intermediate position between said first and second positions.

3. The improvement as claimed in claim 2, wherein said crank and said arm, when the latter is in its second position, have relative dispositions causing the moment arm of said crank and the longitudinal axis of said operating arm to form a right angle, whereby to produce a toggle action to lock the gate member in its lowered position.

4. The improvement as claimed in claim 3, wherein said relative dispositions of said crank and said operating arm prevent said moment arm and said longitudinal axis from forming a right angle when said operating arm is in its first position, whereby to prevent the force transmitting means from locking the gate member in its raised position.

5. The improvement as claimed in claim 1, wherein said drive means is reversible and said force transmitting means, during reverse operation of the drive means, provides said high mechanical advantage at the start of downward movement of said member, said substantially lower mechanical advantage after the member is in motion, and said progressively increased mechanical advantage as the member approaches its lowered position.

6. The improvement as claimed in claim 5, wherein said drive means includes a prime mover and means responsive to downward movement of said member for disabling said prime mover after the member is in motion, whereby the member then falls by gravity and is braked by the progressively increasing mechanical advantage of said force transmitting means.

7. A gate mechanism comprising:

a gate member;

means mounting said gate member for swinging movement about a generally horizontal axis between a raised position and a lowered position corresponding to open and closed conditions of the gate respectively;

an operating arm extending transversely of said axis and secured to said gate member, and having first and second angularly spaced positions corresponding to said raised and lowered positions of the member;

a rotatable crank;

a coupling device pivotally secured to said crank and reciprocable on said arm longitudinally thereof;

drive means for rotating said crank in a direction to swing said arm from said second to said first position thereof to thereby swing said member to its raised position, said crank, coupling device and arm presenting a variable mechanical advantage connection between said drive means and said member; and means mounting said crank with its axis of rotation located to provide high mechanical advantage during initial movement of said arm away from said second position thereof, whereby to minimize the load on said drive means at the start of upward movement of said member.

8. The gate mechanism as claimed in claim 7, wherein said drive means includes an electric motor requiring relatively low starting current due to said high initial mechanical advantage.

9. The gate mechanism as claimed in claim 7, wherein said axis of rotation of the crank is located to direct the major component of the force applied to said arm by the crank longitudinally of the arm when the latter is in said second position thereof, and at a right angle to said arm as the latter is rotated through an intermediate position between said first and second positions, whereby to provide said high mechanical advantage during said initial movement of the arm followed by substantially lower mechanical advantage to accelerate the gate member once it is in motion.

10. The gate mechanism as claimed in claim 9, wherein said crank and said arm, when the latter is in its second position, have relative dispositions causing the moment arm of said crank and the longitudinal axis of said operating arm to form a right angle, whereby to produce a toggle action to lock the gate member in its lowered position.

11. The gate mechanism as claimed in claim 7, wherein said gate member mounting means includes a rotatable shaft defining said generally horizontal axis and to which said member is rigidly secured, said arm being fixed to said shaft.

12. The gate mechanism as claimed in claim 11, wherein said arm extends radially from said shaft, said axis of the shaft and said axis of the crank being in parallelism.

* * * * *